US009354568B2

(12) United States Patent
Cao et al.

(10) Patent No.: US 9,354,568 B2
(45) Date of Patent: May 31, 2016

(54) METHOD AND SYSTEM FOR CONTROLLING A FUSER ASSEMBLY USING TEMPERATURE FEEDBACK

(71) Applicant: Lexmark International, Inc., Lexington, KY (US)

(72) Inventors: Jichang Cao, Lexington, KY (US); James Douglas Gilmore, Georgetown, KY (US); Kevin Dean Schoedinger, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 94 days.

(21) Appl. No.: 13/719,713

(22) Filed: Dec. 19, 2012

(65) Prior Publication Data

US 2014/0169818 A1 Jun. 19, 2014

Related U.S. Application Data

(60) Provisional application No. 61/676,892, filed on Jul. 27, 2012, provisional application No. 61/705,847, filed on Sep. 26, 2012.

(51) Int. Cl.
*G03G 15/20* (2006.01)

(52) U.S. Cl.
CPC ..... *G03G 15/205* (2013.01); *G03G 2215/2035* (2013.01)

(58) Field of Classification Search
CPC ..... G03G 15/2003; G03G 15/2064; G03G 15/2078
USPC ..... 399/68, 69, 70, 328, 329
See application file for complete search history.

(56) References Cited

U.S. PATENT DOCUMENTS

| | | | | |
|---|---|---|---|---|
| 4,081,213 | A | 3/1978 | Bar-on et al. | |
| 5,132,739 | A | 7/1992 | Mauer et al. | |
| 5,489,761 | A * | 2/1996 | Aslam et al. | 219/216 |
| 5,854,957 | A | 12/1998 | Morikawa | |
| 7,205,738 | B2 | 4/2007 | Chapman et al. | |
| 7,274,163 | B1 | 9/2007 | Lambert et al. | |
| 7,359,653 | B2 | 4/2008 | Okamoto | |
| 2003/0081962 | A1 * | 5/2003 | Murata | 399/69 |
| 2004/0202490 | A1 * | 10/2004 | Okamoto | 399/69 |
| 2004/0218942 | A1 | 11/2004 | Gogate et al. | |
| 2005/0163525 | A1 | 7/2005 | Watabe | |
| 2005/0260008 | A1 | 11/2005 | Tatematsu et al. | |
| 2006/0088330 | A1 | 4/2006 | Fujita | |

(Continued)

OTHER PUBLICATIONS

Prosecution history for U.S. Appl. No. 13/651,502, filed Oct. 15, 2012, including Final Office Action dated Sep. 30, 2014 (8 pages).

*Primary Examiner* — Hoang Ngo

(57) ABSTRACT

A method and apparatus for providing a relatively short period of time for a fuser assembly to be ready to perform a fusing operation. Included is a fusing assembly having a heat transfer member and a backup member positioned to engage the heat transfer member so as to define a fusing nip therewith; and a controller coupled to the fuser assembly, wherein during a period of time when the fuser assembly is not performing a fusing operation, the controller causes the backup member to rotate at one or more relatively slow speeds relative to a fusing speed of the fuser assembly while activating the heat transfer member. At least one of a beginning and an ending of the period of time being based upon an actual temperature in the fuser assembly.

24 Claims, 6 Drawing Sheets

(56) References Cited

U.S. PATENT DOCUMENTS

| | | | | |
|---|---|---|---|---|
| 2006/0198651 | A1 | 9/2006 | Tajima | |
| 2006/0216077 | A1 | 9/2006 | Komuro | |
| 2007/0230984 | A1 | 10/2007 | Noguchi | |
| 2008/0131160 | A1 | 6/2008 | Mitsuoka et al. | |
| 2009/0142086 | A1 | 6/2009 | Cao et al. | |
| 2009/0238597 | A1 | 9/2009 | Cao et al. | |
| 2009/0245837 | A1 | 10/2009 | Campbell et al. | |
| 2010/0054785 | A1 | 3/2010 | Ogiso et al. | |
| 2011/0150518 | A1 | 6/2011 | Hase et al. | |
| 2011/0194870 | A1 | 8/2011 | Hase et al. | |
| 2011/0280636 | A1* | 11/2011 | Nakamura et al. | 399/327 |
| 2012/0114359 | A1 | 5/2012 | Yura et al. | |
| 2014/0105628 | A1 | 4/2014 | Cao et al. | |
| 2014/0212161 | A1 | 7/2014 | Cutts et al. | |

* cited by examiner

METHOD AND SYSTEM FOR CONTROLLING A FUSER ASSEMBLY USING TEMPERATURE FEEDBACK

CROSS REFERENCES TO RELATED APPLICATIONS

Pursuant to 35 U.S.C. §119, this application claims the benefit of the earlier filing date of U.S. Provisional Application Ser. No. 61/676,892, filed Jul. 27, 2012, entitled "Improved Method and Apparatus for Controlling a Fuser Assembly," and U.S. Provisional Application Ser. No. 61/705,847, filed Sep. 26, 2012, entitled "A Method and System for Controlling a Fuser Assembly," the contents of which are hereby incorporated by reference herein in their entirety. This application is also related to U.S. application Ser. No. 13/651,502, filed Oct. 15, 2012, entitled "A Method and System for Controlling a Fuser Assembly," the content of which is hereby incorporated by reference herein in its entirety. This application is also related to U.S. Pat. Nos. 7,205,738 and 7,274,163, both of which are assigned to the assignee of this application, the contents of which are hereby incorporated by reference herein in their entirety.

STATEMENT REGARDING FEDERALLY SPONSORED RESEARCH OR DEVELOPMENT

None

REFERENCE TO SEQUENTIAL LISTING, ECT

None

BACKGROUND

1. Field of the Disclosure

The present disclosure relates generally to controlling a fuser assembly in an electrophotographic imaging device, such as a laser printer or multifunction device having printing capability, and particularly to maintaining sufficient energy levels within a fuser assembly for a period of time when not performing a fusing operation so as to allow for relatively short time to reach fusing temperatures without substantially increasing overall energy usage by the imaging device.

2. Description of the Related Art

Manufacturers of printing devices are continuingly challenged to improve printing device performance. One way in which improvement is sought is with respect to achieving a shorter time to printing a first media sheet of a print job (hereinafter "first print time"). To deliver improved first print times, one approach is for laser printers to keep its fuser assembly, i.e., the assembly which fuses deposited toner into a sheet of media, heated at a relatively warm temperature less than a temperature for fusing toner. Such an approach has been met with some success but even shorter first print times are nevertheless desired.

SUMMARY

Example embodiments overcome shortcomings of existing laser printing devices and thereby satisfy a significant need for controlling a fuser assembly to yield a reduced first print time in a relatively energy efficient manner. According to one example embodiment, an imaging device includes a fuser assembly having a heat transfer member and a backup roll positioned to engage the heat transfer member thereby defining a fusing nip therewith. A controller controls the fuser assembly such that during a period of time when the fuser assembly is not performing a fusing operation, the controller activates the heat transfer member while controlling the backup roll to rotate at a relatively slow speed relative to a fusing speed of the fuser assembly. Slowly rotating the backup roll while heating the heat transfer member during a period when toner fusing does not occur advantageously ensures that the backup roll stores an acceptable amount of energy to allow the fuser assembly to quickly reach a state for fusing toner to media sheets. At least one of a beginning and an ending of the period of time is based upon an actual temperature sensed in the fuser assembly.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings, wherein.

DETAILED DESCRIPTION

Figure 1:
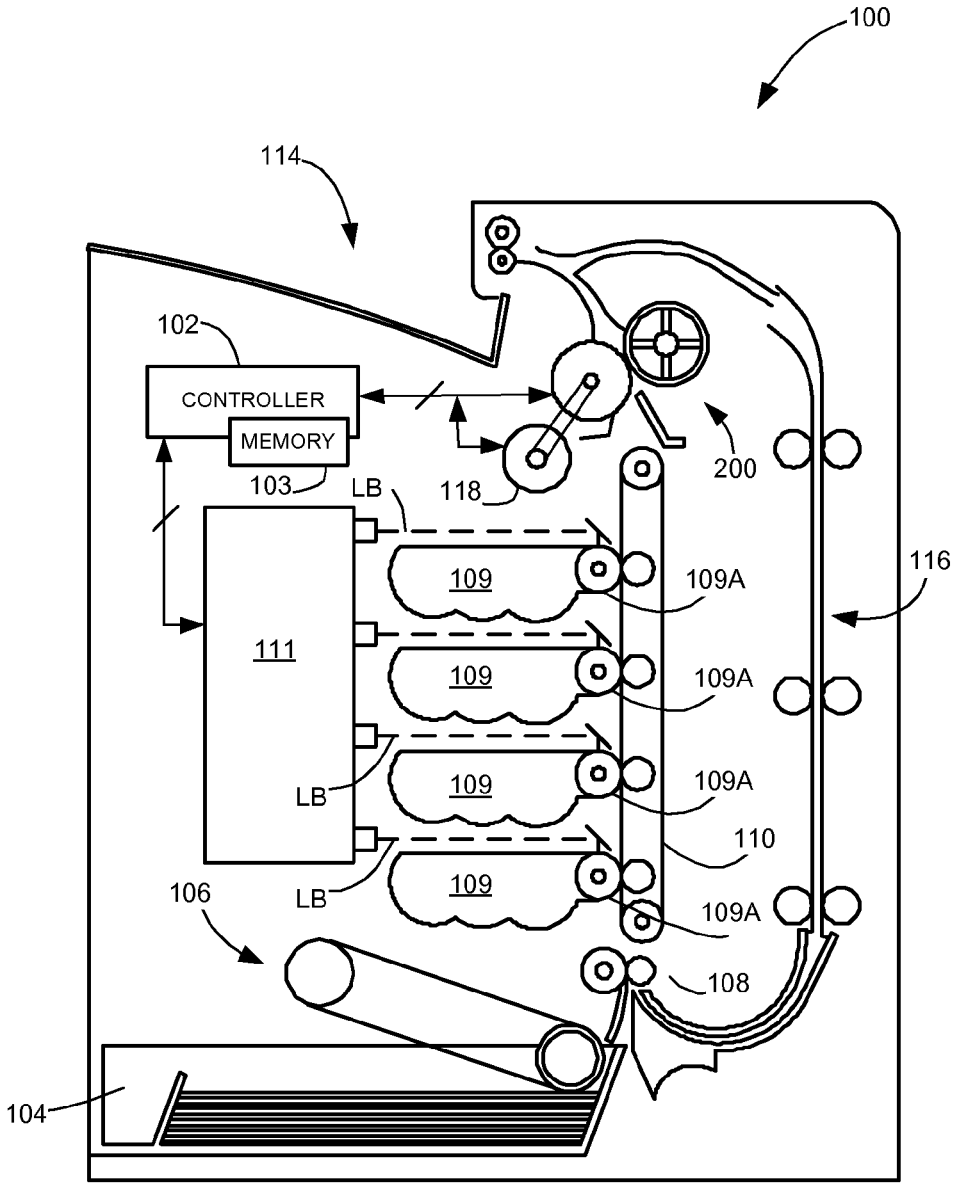
FIG. 1 is a side elevational view of an improved imaging device according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

Referring now to the drawings and particularly to FIG. 1, there is shown an imaging device in the form of a color laser printer, which is indicated generally by the reference numeral 100. An image to be printed is typically electronically transmitted to a processor or controller 102 by an external device (not shown) or the image may be stored in a memory 103 embedded in or associated with the controller 102. Memory 103 may be any volatile and/or non-volatile memory such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may include one or more processors and/or other logic necessary to control the functions involved in electrophotographic imaging.

In performing a print operation, controller 102 initiates an imaging operation in which a top media sheet of a stack of media is picked up from a media or storage tray 104 by a pick mechanism 106 and is delivered to a media transport apparatus including a pair of aligning rollers 108 and a media transport belt 110 in the illustrated embodiment. The media transport belt 110 carries the media sheet along a media path past four image units or stations 109 which apply toner to the media sheet through cooperation with laser scan unit 111. Each image unit 109 provides toner forming a distinct color image plane to the media sheet. Laser scan unit 111 emits modulated light beams LB, each of which forms a latent image on a photoconductive surface or drum 109A of the corresponding image unit 109 based upon the bitmap image data of the corresponding color plane. The operation of laser scan units and image units is known in the art such that a detailed description of their operation will not be provided for reasons of expediency.

Fuser assembly 200 is disposed downstream of image units 109 and receives from media transport belt 110 media sheets with the unfused toner images superposed thereon. In general terms, fuser assembly 200 applies heat and pressure to the media sheets in order to fuse toner thereto. After leaving fuser assembly 200, a media sheet is either deposited into output media area 114 or enters duplex media path 116 for transport to the most upstream image unit 109 for imaging on a second surface of the media sheet.

Imaging device 100 is depicted in FIG. 1 as a color laser printer in which toner is transferred to a media sheet in a single transfer step. Alternatively, imaging device 100 may be a color laser printer in which toner is transferred to a media sheet in a two step process— from image units 109 to an intermediate transfer member in a first step and from the intermediate transfer member to the media sheet in a second step. In another alternative embodiment, imaging device 100 may be a monochrome laser printer which utilizes only a single image unit 109 for depositing black toner to media sheets. Further, imaging device 100 may be part of a multifunction product having, among other things, an image scanner for scanning printed sheets.

Figure 2:
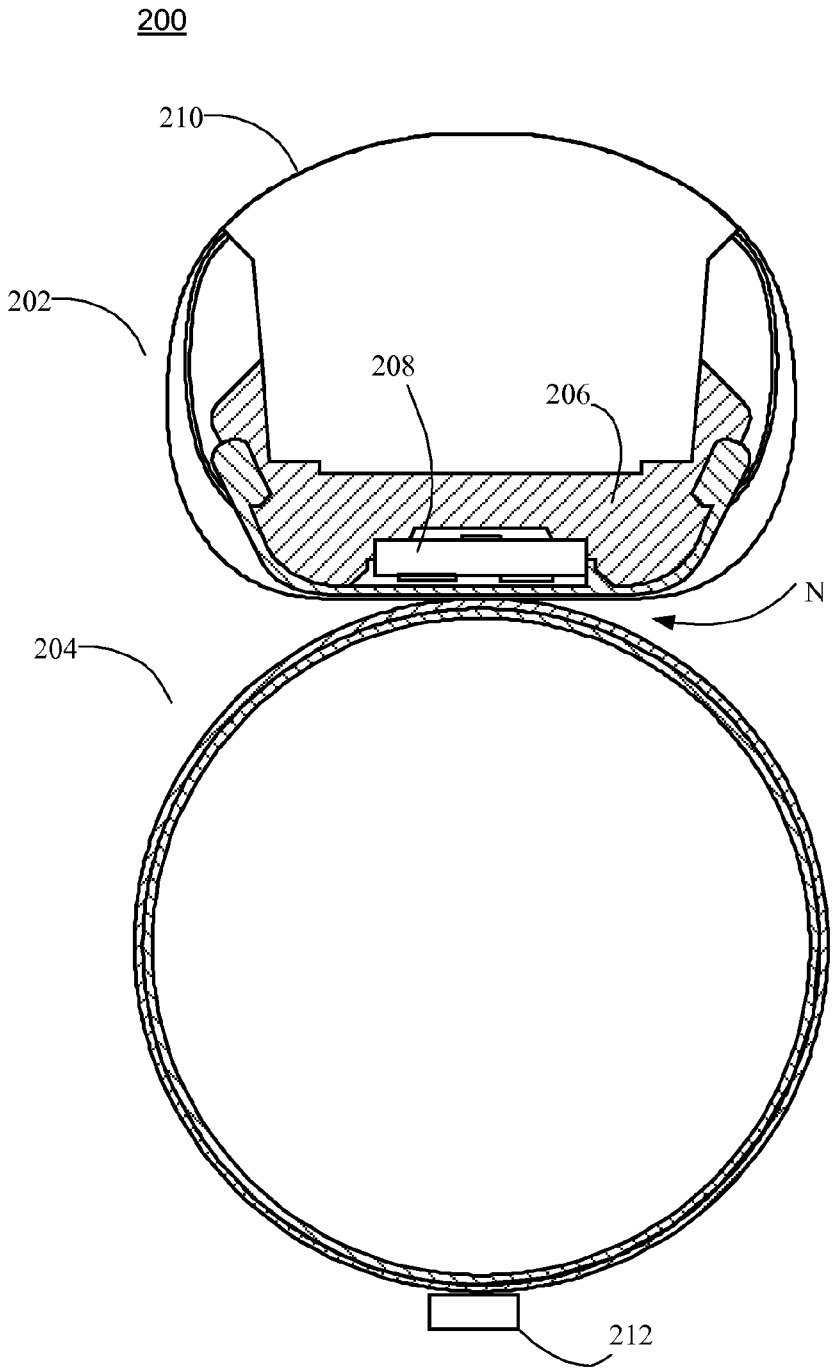
FIG. 2 is a cross sectional view of a fuser assembly of FIG. 1.

With respect to FIG. 2, fuser assembly 200 may include a heat transfer member 202 and a backup roll 204 cooperating with the heat transfer member 202 to define a fuser nip N for conveying media sheets therein. The heat transfer member 202 may include a housing 206, a heater element 208 supported on or at least partially in housing 206, and an endless flexible fuser belt 210 positioned about housing 206. Heater element 208 may be formed from a substrate of ceramic or like material to which one or more resistive traces is secured which generates heat when a current is passed through the resistive traces. Heater element 208 may further include at least one temperature sensor, such as a thermistor, coupled to the substrate for detecting a temperature of heater element 208. It is understood that heater element 208 alternatively may be implemented using other heat generating mechanisms.

Fuser belt 210 is disposed around housing 206 and heater element 208. Backup roll 204 contacts fuser belt 210 such that fuser belt 210 rotates about housing 206 and heater element 208 in response to backup roll 204 rotating. With fuser belt 210 rotating around housing 206 and heater element 208, the inner surface of fuser belt 210 contacts heater element 208 so as to heat fuser belt 210 to a temperature sufficient to perform a fusing operation to fuse toner to sheets of media. Backup roll 204 may include or be associated with a sensing element 212 which senses the temperature of backup roll 204 and generates an electrical signal (not shown) that is provided to controller 102.

Heat transfer member 202 and backup roll 204 may be constructed from the elements and in the manner as disclosed in U.S. Pat. No. 7,235,761, the content of which is incorporated by reference herein in its entirety. It is understood, though, that fuser assembly 200 may have a different architecture than a fuser belt based architecture. For example, fuser assembly 200 may be a hot roll fuser, including a heated roll and a backup roll engaged therewith to form a fuser nip through which media sheets traverse.

Figure 3:
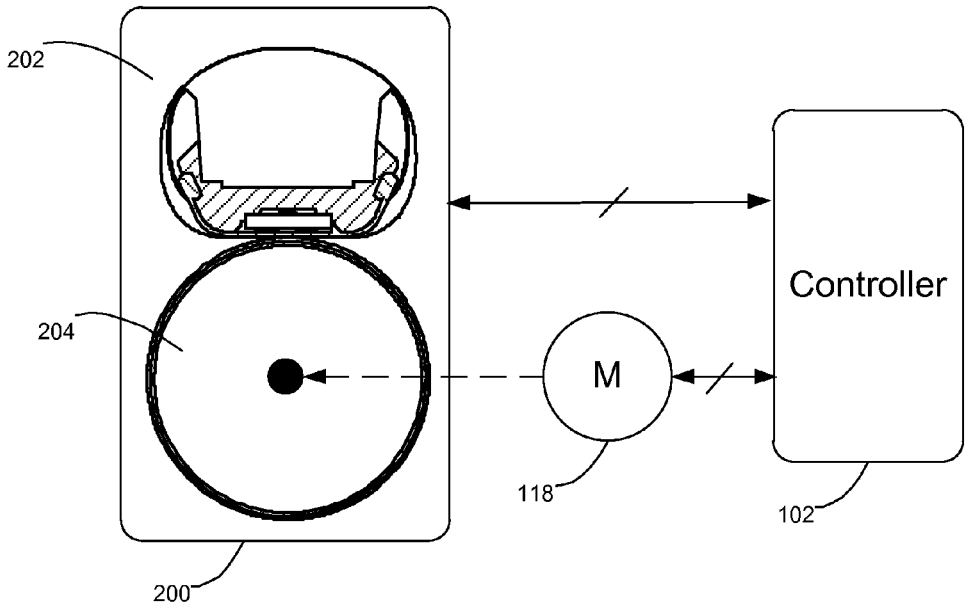
FIG. 3 is a block diagram illustrating electrical and mechanical coupling between components of the imaging device of FIG. 1.

Backup roll 204 may be driven by motor 118 (FIG. 1). Motor 118 may be any of a number of different types of motors. For instance, motor 118 may be a brushless D.C. motor or a stepper motor. Motor 118 may be coupled to backup roll 204 by any of a number of mechanical coupling mechanisms, including but not limited to a gear train (not shown). For simplicity, FIG. 3 represents the mechanical coupling between motor 118 and backup roll 204 as a dashed line. FIG. 3 also illustrates the communication between controller 102, motor 118 and fuser assembly 200. In particular, controller 102 generates control signals for controlling the movement of motor 118 and the temperature of heater element 208. Controller 102 may control motor 118 and heater element 208 during a fusing operation, for example, based in part upon feedback signals provided thereby. It is understood that additional circuitry may be disposed between controller 102, motor 118 and fuser assembly 200, including but not limited to driver circuitry for suitably conditioning control signals for driving motor 118 and heating heater element 208.

During a fusing operation, controller 102 controls heater element 208 to generate heat within a desired range of fusing temperatures. In addition, controller 102 controls motor 118 to cause backup roll 204 to rotate at a desired fusing speed during a fusing operation. The desired fusing speed and range of fusing temperatures are selected for achieving relatively high processing speeds and effective toner fusing without appreciably affecting the useful life of, for example, fuser belt 210 and backup roll 204. Processing speeds and useful life are two performance based characteristics often associated with fuser assemblies.

In addition, the first print time is another performance based characteristic associated with imaging devices and, as a result, fuser assemblies. Because fuser assemblies need time in order to be heated to a fusing temperature prior to performing a fusing operation, the heating performance of a fuser assembly is often a contributing factor in an imaging device achieving an acceptable first print time. To be able to meet small first print times while providing acceptable levels of toner fusing, a sufficient amount of thermal energy may be stored in fuser assembly 200 prior to a media sheet reaching fuser nip N of the fuser assembly. Controller 102 generally controls fuser assembly 200 during periods of time when fuser assembly 200 is not performing a fusing operation so as to maintain a sufficient amount of thermal energy in backup roll 204 and enable the temperature in fuser nip N of fuser assembly 200 to quickly reach fusing temperatures. These periods of time may be seen as a standby mode for imaging device 100 and/or fuser assembly 200.

According to an example embodiment, when in a standby mode controller 102 activates heater element 208 to heat to a predetermined temperature and selectively controls motor 118 to cause backup roll 204 to relatively slowly rotate. By heating fuser assembly 200 while slowly rotating backup roll 204 during periods when fuser assembly is not performing a fusing operation, a sufficient amount of thermal energy is maintained generally uniformly throughout backup roll 204 such that the first print time is substantially reduced.

In an example embodiment, controller 102 controls heater element 208 to heat at a predetermined temperature less than a fusing temperature. For example, the predetermined temperature may be between about 140 degrees C. and about 180 degrees C., and particularly between about 150 degrees C. and about 170 degrees C., such as about 160 degrees C. It is understood, however, that the particular temperature at which heater element 208 may be heated, i.e., activated to generate heat, during the time when backup roll 204 slowly rotates and when fuser assembly is not performing a fusing operation may vary and depend upon a number of target performance factors, including speed, energy consumption and/or fuser life based factors.

As mentioned, during the standby mode controller 102 may control motor 118 to cause backup roll 204 to relatively slowly rotate while heater element 208 is heated to a temperature less than a fusing temperature. In an example embodiment, controller 102 may control motor 118 to cause backup roll 204 to rotate between about 0.2 revolutions per minute (rpm) and about 10 rpm with all increments in between, and more particularly between about 0.4 rpm and about 2.5 rpm, such as about 0.5 rpm. Such slow rotational speeds represent a small fraction of a fusing speed, i.e., a speed of backup roll 204 when fuser assembly 200 is performing a fusing operation. For example, the slow rotational speeds of backup roll 204 may be about 1/250 to about 1/500 of a fusing speed for fuser assembly 200. Alternatively, the relatively slow rotation of backup roll 204 may be at a speed discussed above, or at speeds between about 10 rpm and about 40 rpm with all increments in between, and particularly between about 15 rpm and about 35 rpm, such as about 25 rpm. In another alternative embodiment, the speed of backup roll 204 may vary in a predetermined manner. It is understood that backup roll 204 may be rotated at other rotational speeds and the particular speed or speeds may be selected based upon a number of target performance factors, including speed, energy consumption and/or fuser life based factors. It is further understood that in an alternative embodiment, heater element 208 may be heated during the standby mode by controller 102 to a temperature at or greater than the fusing temperature. In yet another embodiment, heater element 208 may be heated during the standby mode to a temperature below the fusing temperature during one portion of the standby mode and a temperature at or above the fusing temperature during another portion of the standby mode.

The way in which backup roll 204 is relatively slowly rotated may vary. In an example embodiment, controller 102 may control motor 118 to substantially continuously rotate backup roll 204. In another example embodiment, controller 102 may control motor 118 to rotate backup roll 204 in a series of discrete and/or discontinuous movements. Each such movement may be identical to each other or may vary therefrom in duration, rotational speed and/or distance.

During the period of time imaging device 100 and/or fusing assembly 200 is in the standby mode and relatively slowly rotating backup roll 204, motor 118 may be operated using time-based commutation. For example, controller 102 may include the functionality described in U.S. Pat. Nos. 7,205,738 and/or 7,274,163 and U.S. patent application No. 61/705,847, filed Sep. 26, 2012, entitled "Method and System for Controlling a Fuser Assembly," and assigned to the assignee of the present application, the contents of which are hereby incorporated by reference herein in their entirety. In an example embodiment, imaging device 100 may utilize time-based commutation for relatively slowly rotating backup roll 204. Specifically, controller 102 may include or be coupled to commutation logic circuitry utilizing one or more lookup tables, with each addressable location in a lookup table maintaining a motor drive value corresponding to a discrete position of motor 118. The motor drive values in a lookup table may then be used in generating the drive signals for motor 118 for a single commutation cycle thereof. In the example embodiment, at least one lookup table maintains motor drive values so that the current flowing in the windings of motor 118 follows a generally sinusoidal waveform.

Controller 102 may control heater element 208 during the standby mode in an open loop manner, a closed loop manner or both so as to control the temperature of fuser assembly 200. For open loop control of heater element 208, controller 102 may supply a predetermined portion of available power to heater element 208 for heating same, such as between about 10% and about 20%, for example. The amount of the predetermined portion of available power to be supplied to heater element 208 may be chosen to be sufficiently low to ensure that components of fuser assembly 200 do not overheat during standby mode. Application of power to heater element 208 during open loop control may be substantially continuous or cycled between full power and no power. For closed loop control of heater element 208, the temperature of heater element 208 is fed back to controller 102 for use in controlling the temperature of heater element 208.

In an example embodiment, when imaging device 100 and/or fuser assembly 200 is in the standby mode, controller 102 may activate heater element 208. In addition, controller 102 may cause backup roll 204 to slowly rotate based upon the actual temperature of backup roll 204 as sensed by sensing element 212. For instance, controller 102 may cause backup roll 204 to relatively slowly rotate in response to the actual temperature of backup roll 204 falling to or below a first predetermined temperature value. The first predetermined temperature value may be between, for example, about 50 degrees C. and about 90 degrees C., and particularly between about 60 degrees C. and about 80 degrees C., such as 70 degrees C. It is understood, however, that the first predetermined temperature value may be another temperature either below or above a fusing temperature.

When in the standby mode, controller 102 may also cause backup roll 204 to cease slow rotation in response to the actual temperature of backup roll 204 reaching or surpassing a second predetermined temperature value. The second predetermined temperature value may greater than the first predetermined temperature value by an amount between about 10 degrees C. and about 40 degrees C., and particularly between about 15 degrees C. and about 30 degrees C., such as about 20 degrees C. It is understood, however, that the second predetermined temperature value may be greater than the first predetermined temperature value by other amounts.

In this example embodiment, controller 102 begins relatively slow rotation of backup roll 204 in the standby mode when the actual temperature of backup roll 204 is sensed by sensing element 212 to fall to or below the first predetermined temperature value, and ceases slow rotation of backup roll 204 when the actual temperature of backup roll 204 reaches and/or surpasses the second predetermined temperature value. It is understood, though, that either initiating or ceasing slow rotation of backup roll 204 may occur based upon an estimated temperature of backup roll 204 instead of the actual temperature thereof. Specifically, in the event controller 102 initiates slow rotation of backup roll 204 in response to the actual temperature of backup roll 204 falling below the first predetermined temperature value, controller 102 may, in an example embodiment, cease slowly rotating backup roll 204 based upon a temperature of backup roll 204 being estimated by controller 102 to reach or surpass the second predetermined temperature value. The estimated temperature of backup roll 204 may be based at least in part upon the last actual temperature of backup roll 204 sensed, the thermal characteristics of heating element 208, fuser belt 210 and backup roll 204, environmental conditions and/or the rotational speed of backup roll 204. Controller 102 may, for example, use a counter that is timed to a predetermined period of time following initial slow rotation at which backup roll 204 is estimated to reach the second predetermined temperature value. The predetermined period of time the counter counts may be based upon the above-mentioned thermal characteristics, environmental conditions and standby mode speed of fuser assembly 200. Instead of use of a counter, controller 102 may count the number of revolutions of backup roll 204 following initial slow rotation thereof to determine, with the known speed of backup roll 204, the time at which backup roll 204 is estimated to reach or surpass the second predetermined temperature value.

Alternatively, controller 102 may initiate slow rotation of backup roll 204 in the standby mode based upon an estimated temperature of backup roll 204 reaching or falling below the first predetermined temperature value, and to cease such slow rotation based upon the actual temperature of backup roll 204 surpassing the second predetermined temperature value. The estimated temperature of backup roll 204 in this embodiment may be based at least in part upon the last actual temperature of backup roll 204 sensed, the current temperature at which heater element 208 is maintained, the thermal characteristics of heating element 208, fuser belt 210 and backup roll 204, environmental conditions and/or the rotational speed of backup roll 204. In addition or in the alternative, the time when backup roll 204 is estimated to fall below the first predetermined temperature value may be based upon the period of time since entering the standby mode, wherein the period of time may be based upon the above factors. Controller 102 may, for example, use a counter that is timed to a predetermined period of time following heater element 208 entering the standby mode. The predetermined period of time may vary. For instance, the predetermined period of time may be a greater amount when immediately following a fusing operation than immediately following an operational mode in which heater element 208 is heated to a lower temperature than a fusing temperature.

Figure 4:
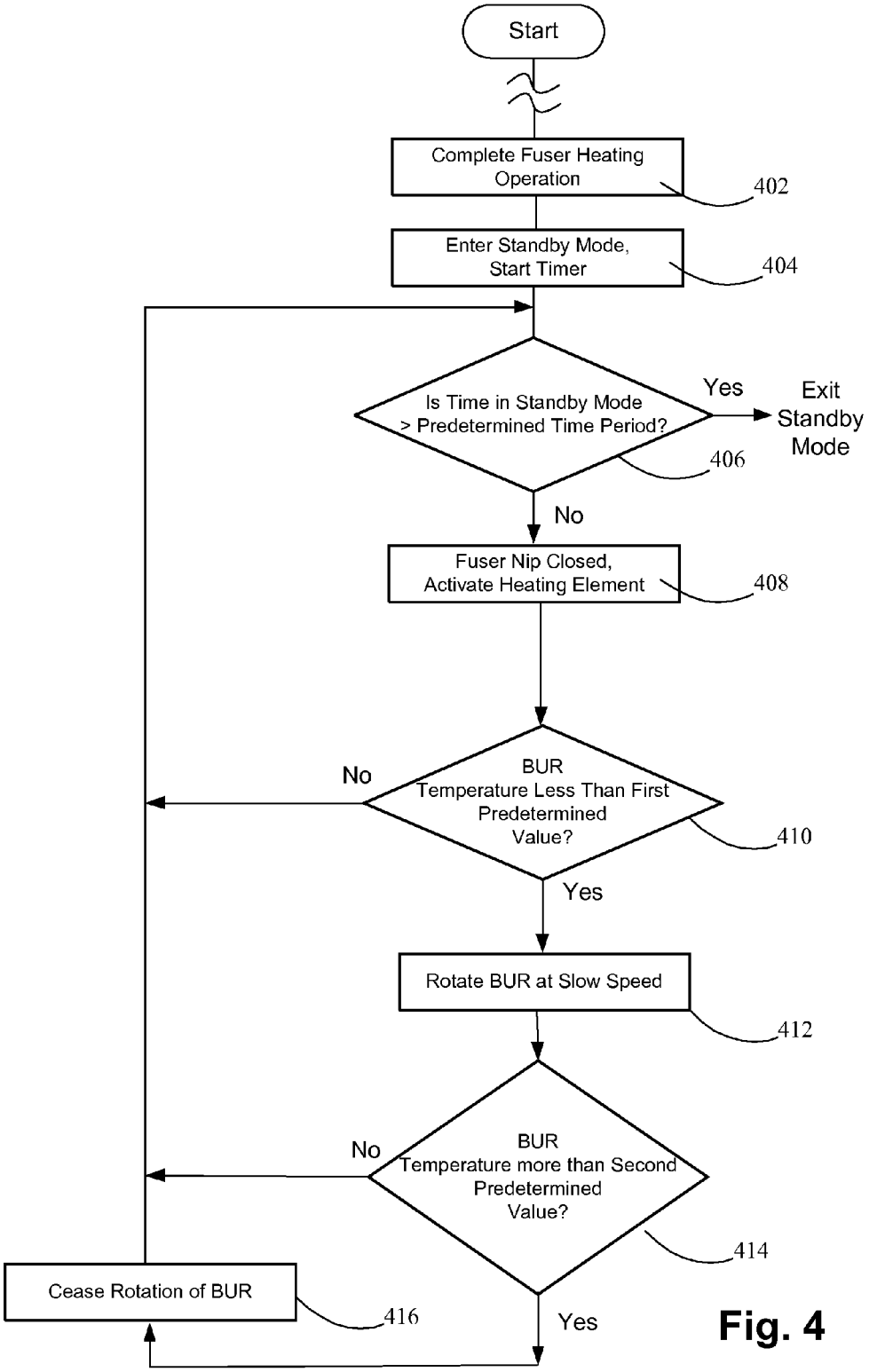
FIG. 4 is a flowchart illustrating a method of controlling the fuser assembly of FIG. 2 according to an example embodiment.

An operation of imaging device 100 will now be described with reference to FIG. 4, according to an example embodiment. It is understood that the order of the acts described hereinbelow is presented for illustrative purposes only, and that the acts may be ordered in a different manner.

Following completion of a fusing operation at 402 or other operation involving heater element 208 being activated to generate heat, controller 102 causes fuser assembly 200 to enter the standby mode at 404. At this time, a timer associated with controller 102 is activated to begin counting. A determination is made at 406 as to whether a predetermined period of time elapsed since entering the standby mode. Upon an affirmative determination, controller 102 causes fuser assembly 200 to exit the standby mode and enter a different mode, such as a different standby mode. Upon a negative determination at 406, fuser nip N is closed or remains closed at 408. At this time, heater element 208 may be activated by controller 102 to generate heat. Alternatively, heater element 208 may be deactivated and/or remain deactivated and only generate heat from heater element 208 having been previously activated. In an example embodiment, heater element 208 is controlled to about 160 degrees C., but it is understood that other temperatures may be used.

At 410, a determination is made whether backup roll 204 is less than or equal to the first predetermined temperature value. In one embodiment, the determination is whether the actual temperature of backup roll 204 is at or below the first predetermined temperature value as sensed by sensing element 212, and in another embodiment the determination concerns an estimate of the temperature of backup roll 204. If the temperature is not at or below the first predetermined temperature value, control returns to act 406. If the temperature of backup roll 204 is less than or equal to the first predetermined temperature value, backup roll 204 is slowly rotated at 412 in a manner as described above. At this time, a second timer associated with controller 102 may be activated. During the time heater element 208 is heated and backup roll 204 is slowly rotated, thermal energy is maintained substantially throughout backup roll 204. Depending upon the temperature of heater element 208 and the rotational speed of backup roll 204, the thermal energy may be maintained in backup roll 204 substantially uniformly.

At 414, a determination is made whether the temperature of backup roll 204 reached or surpassed the second predetermined temperature value. In an example embodiment, controller 102 determines whether the actual temperature of backup roll 204, sensed by sensing element 212, has reached or surpassed the second predetermined temperature value. In another example embodiment, controller 102 determines that an estimate of the temperature of backup roll 204 has reached or surpassed the second predetermined temperature value. In this embodiment in which an estimate of the temperature of backup roll 204 is used, the temperature estimate may be based upon the second counter having counted a predetermined period of time or the number of revolutions corresponding thereto since initial slow rotation of backup roll 204. For this embodiment in which is used the estimate of the temperature of backup roll 204 reaching or surpassing the second predetermined temperature value, imaging device 100 and fuser assembly 200 had initially rotated backup roll 204 following a determination by controller 102 that the actual temperature of backup roll 204 had reached or fallen below the first predetermined temperature value.

If a determination that the temperature of backup roll 204 has not reached or surpassed the second predetermined temperature value, control returns to act 406. Upon an affirmative determination, controller 102 causes backup roll 204 to cease slow rotation at 416, after which control returns to act 406.

In an alternative example embodiment, controller 102 causes imaging device 100 and fuser assembly 200 to enter, exit or both enter and exit the standby mode in response to the actual temperature of backup roll 204 sensed by sensing element 212. For instance, controller 102 may cause imaging device 100 and/or fuser assembly 200 to enter the standby mode in response to the actual temperature of backup roll 204 falling below the first predetermined temperature value. Controller 102 may also cause imaging device 100 and/or fuser assembly 200 to exit the standby mode in response to the actual temperature of backup roll 204 reaching or surpassing the second predetermined temperature value. In this way, heater element 208 is activated and backup roll 204 slowly rotated at around the same time during the entirety of the standby mode.

Specifically, in one example embodiment, controller 102 enters the standby mode when the actual temperature of backup roll 204 is sensed by sensing element 212 to fall below the first predetermined temperature value, and exits the standby mode when the actual temperature of backup roll 204 reaches and/or surpasses the second predetermined temperature value. It is understood, though, that either entry into or exit from the standby mode may occur based upon an estimated temperature of backup roll 204 instead of the actual temperature thereof. Specifically, in the event imaging device 100 and/or fuser assembly 200 enters the standby mode in response to the actual temperature of backup roll 204 falling below the first predetermined temperature value, controller 102 may, in an example embodiment, cause imaging device 100 and/or fusing assembly 200 to exit the standby mode based upon a temperature of backup roll 204 being estimated by controller 102 to reach or surpass the second predetermined temperature value. The estimated temperature of backup roll 204 may be based at least in part upon the last actual temperature of backup roll 204 sensed, the thermal characteristics of heating element 208, fuser belt 210 and backup roll 204, environmental conditions and/or the rotational speed of backup roll 204. Controller 102 may, for example, use a counter that is timed to a predetermined period of time following entry into the standby mode at which backup roll 204 is estimated to reach the second predetermined temperature value. The predetermined period of time the counter counts may be based upon the above-mentioned thermal characteristics, environmental conditions and standby mode speed of fuser assembly 200. Instead of use of a counter, controller 102 may count the number of revolutions of backup roll 204 following entry into the standby mode to determine, with the known speed of backup roll 204 therein, the time at which backup roll 204 is estimated to reach or surpass the second predetermined temperature value.

Alternatively, controller 102 may cause imaging device 100 and/or fusing assembly 200 to enter the standby mode based upon an estimated temperature of backup roll 204 reaching or falling below the first predetermined temperature value, and to exit the standby mode based upon the actual temperature of backup roll 204 surpassing the second predetermined temperature value. The estimated temperature of backup roll 204 in this embodiment may be based at least in part upon the last actual temperature of backup roll 204 sensed, the thermal characteristics of heating element 208, fuser belt 210 and backup roll 204, environmental conditions and/or the rotational speed of backup roll 204. In addition or in the alternative, the time when backup roll 204 is estimated to fall below the first predetermined temperature value may be based upon the period of time since fusing assembly 200 was last activated to generate heat, such as during a fusing operation, a power-on-reset operation, a general warm-up operation, or a prior standby mode of operation. Controller 102 may, for example, use a counter that is timed to a predetermined period of time following heater element 208 being activated to generate heat. The predetermined period of time may vary and be based upon the last heat generating activity, wherein the predetermined period of time may be a greater amount when immediately following a fusing operation than immediately following an operational mode in which heater element 208 is heated to a lower temperature than a fusing temperature.

Figure 5:
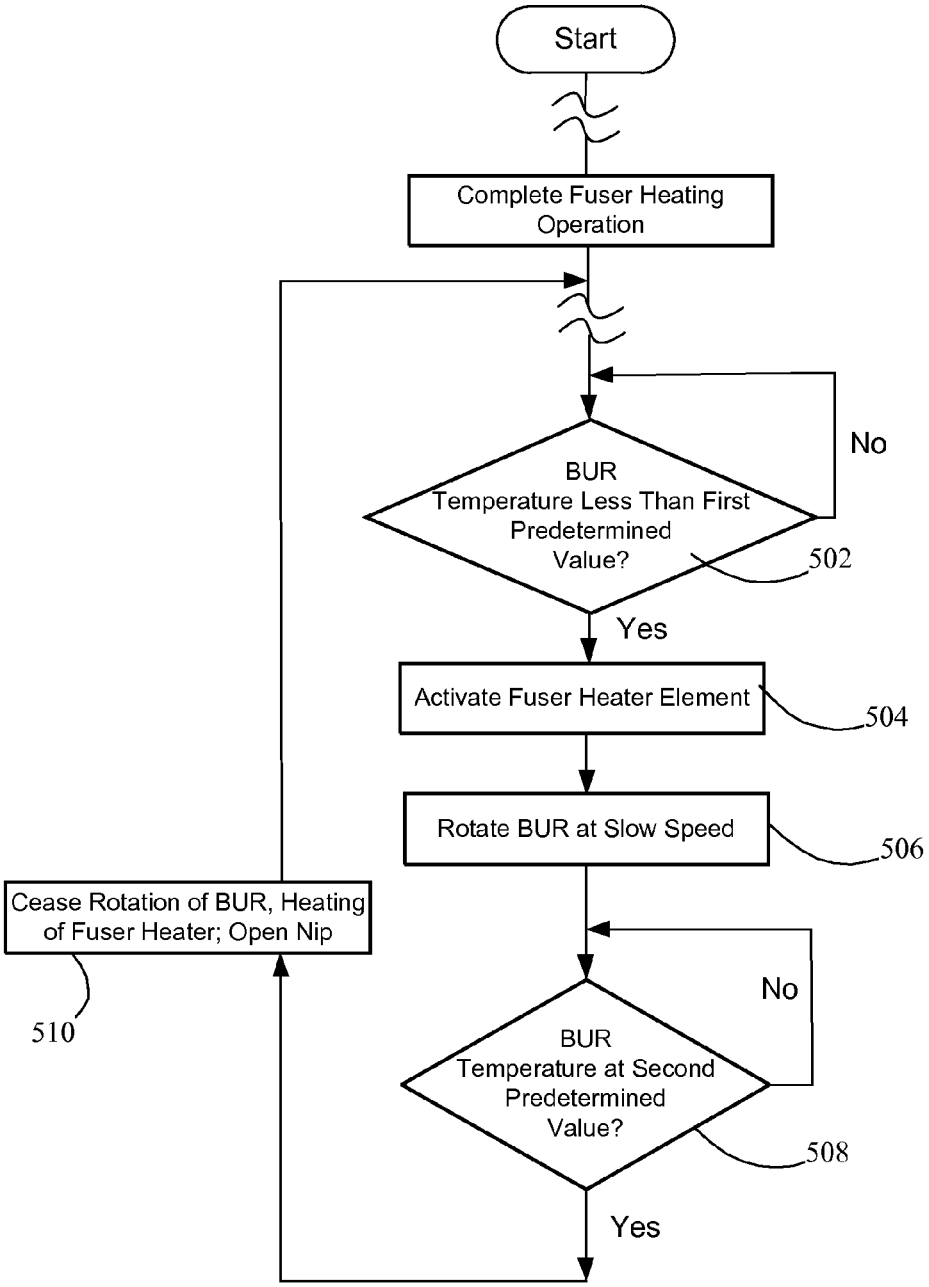
FIG. 5 is a flowchart illustrating another method of controlling the fuser assembly of FIG. 2 according to another example embodiment.

An operation of imaging device 100 will now be described with reference to FIG. 5, according to the above-discussed alternative example embodiment. It is understood that the order of the acts described hereinbelow is presented for illustrative purposes only, and that the acts may be ordered in a different manner. At some point following fuser assembly 200 completing a fusing operation or other operation involving heater element 208 being activated, at 502 a determination is made, such as by controller 102, whether the temperature of backup roll 204 is at or below the first predetermined temperature value. In one embodiment, the determination is whether the actual temperature of backup roll 204 is at or below the first predetermined temperature value as sensed by sensing element 212, and in another embodiment the determination concerns an estimate of the temperature of backup roll 204. With respect to the latter embodiment, the estimated temperature of backup roll 204 is at or below the first predetermined temperature value may be based upon a counter reaching a counter value corresponding to the lapse of a predetermined period of time, with the predetermined period of time being based upon any of a number of factors as described above.

Upon an affirmative determination that the temperature of backup roll 204 is at or below the first predetermined temperature value, imaging device 100 enters the standby mode in which the temperature of heater element 208 is heated at 504 to a predetermined temperature, such as a temperature that is less than a fusing temperature, and backup roll 204 is initially slowly rotated at 506. Alternatively, heater element 208 is not activated to generate heat such that any heat emitted therefrom is due to a prior activation. During the time heater element 208 is heated and backup roll 204 is slowly rotated, thermal energy is maintained substantially throughout backup roll 204. Depending upon the temperature of heater element 208 and the rotational speed of backup roll 204, the thermal energy may be maintained in backup roll 204 substantially uniformly. In the event that exit from the standby mode will be based upon an estimate of the temperature of backup roll 204 reaching or surpassing the second predetermined temperature value, controller 102 may activate a counter to begin counting for a predetermined period of time or begin counting the number of revolutions of backup roll 204, as explained above.

The heating and slow rotating continues in the standby mode until controller 102 determines at 508 that the temperature of backup roll 204 has reached or exceeded the second predetermined temperature value. In an example embodiment, controller 102 determines that the actual temperature of backup roll 204, sensed by sensing element 212, has reached or surpassed the second predetermined temperature value. In another example embodiment, controller 102 determines that an estimate of the temperature of backup roll 204 has reached or surpassed the second predetermined temperature value. In this embodiment in which an estimate of the temperature of backup roll 204 is used, the temperature estimate may be based upon the counter having counted the predetermined period of time or the number of revolutions corresponding thereto. For this embodiment in which is used the estimate of the temperature of backup roll 204 reaching or surpassing the second predetermined temperature value, imaging device 100 and fuser assembly 200 had previously entered the standby mode following a determination by controller 102 that the actual temperature of backup roll 204 had reached or fallen below the first predetermined temperature value.

Following an affirmative determination that the temperature of backup roll 204 has reached or surpassed the second predetermined temperature value, at 510 controller 102 may exit the standby mode by ceasing rotating backup roll 204 and optionally discontinue activating heater element 208. In addition, fuser nip N may be opened by activating a mechanism to separate backup roll 204 from heat transfer member 202. Thereafter, imaging device 100 and/or fuser assembly 200 may enter a different mode of operation.

Figure 6:
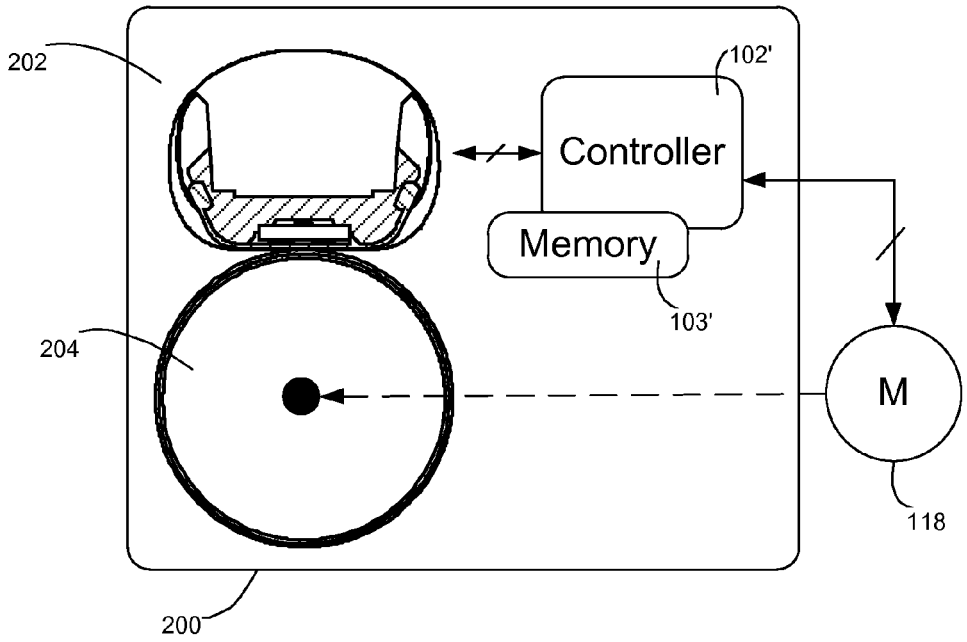
FIG. 6 is a block diagram illustrating electrical and mechanical coupling between components of the imaging device of FIG. 1 according to an alternative embodiment.

As mentioned, controller 102 may be implemented using one or more processors. FIG. 6 depicts one such processor or controller 102' and memory 103' coupled thereto, mounted and/or physically connected to fuser assembly 200, in accordance with an example embodiment. Controller 102' may generally control the operation of motor 118 and fuser assembly 200, and controller 102 may control the operation of other components and assemblies within imaging device 100.

The foregoing description of several methods and an embodiment of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An apparatus, comprising:

a fuser assembly comprising a heat transfer member and a backup member positioned to engage the heat transfer member thereby defining a fusing nip therewith; and a controller coupled to the fuser assembly, wherein during a period of time when the fuser assembly is not performing a fusing operation, the controller causes the backup member to rotate at least one relatively slow speed relative to a fusing speed of the fuser assembly, at least one of a beginning and an ending of the period of the time being based upon an actual temperature of the backup member, wherein the controller causes the backup member to cease rotating and the fusing nip to open at the ending of the period of time, and wherein prior to the period of time, the controller estimates whether a temperature of the backup member is at or below a first predetermined temperature, the controller causing the backup member to relatively slowly rotate responsive to an affirmative estimation at the beginning of the period of time, the ending of the period of time being based upon the actual temperature of the backup member reaching or surpassing a second predetermined temperature.

2. The apparatus of claim 1, wherein the controller is physically mounted to the fuser assembly.

3. The apparatus of claim 1, wherein the at least one relatively low speed is between about 0.3 revolutions per minute (rpm) and about 40 rpm.

4. The apparatus of claim 1, wherein during the period of time, the backup member is substantially continuously rotated.

5. The apparatus of claim 1, wherein during the period of time, the backup member is rotated in a plurality of discrete movements.

6. The apparatus of claim 1, wherein during the period of time the backup member is relatively slowly rotated, the actual temperature of the backup member is between about 50 degrees C. and about 130 degrees C.

7. The apparatus of claim 1, wherein the estimated temperature of the backup member is based at least in part upon at least one of a last actual temperature measurement of the backup member, thermal characteristics of the heat transfer member and the backup member, one or more environmental conditions of the apparatus, and a rotational speed of the backup member during the period of time.

8. The apparatus of claim 7, further comprising at least one counter communicatively coupled to the controller for counting, wherein the at least one counter counts one of the period of time and a number of rotations of the backup member during the period of time.

9. An apparatus for an imaging device, comprising:

A fuser assembly for performing fuser operations within the imaging device, comprising a heater element and a backup roll; and a controller coupled to the fuser assembly, wherein when the fuser assembly is not performing a fuser operation, the controller causes the heater element to heat and, during a period of time, the backup roll to slowly rotate at one or more speeds less than the fusing speed of the fuser assembly, at least one of a beginning and an ending of the period of time being based upon an actual temperature in the fuser assembly, wherein one of the beginning and the ending of the period of time is based upon the actual temperature of the backup roll, and the other of the beginning and the ending of the period of time is based upon an estimated temperature of the backup roll.

10. The apparatus of claim 9, wherein during the period of time, the heater element is activated to generate heat at a temperature that is less than a temperature for performing a fusing operation.

11. The apparatus of claim 9, wherein during the period of time the backup roll is rotated between about 0.3 rpm and about 40 rpm.

12. The apparatus of claim 9, wherein prior to the period of time, the controller estimates a temperature of the backup roll and determines whether the estimated temperature is at or below a first predetermined temperature, the controller causing the backup roll to rotate responsive to an affirmative determination.

13. The apparatus of claim 12, wherein the ending of the period of time occurs in response to the actual temperature rising to or above a second predetermined temperature.

14. The apparatus of claim 9, wherein during the period of time, the backup roll is rotated substantially continuously.

15. The apparatus of claim 9, wherein during the period of time, the backup roll is rotated in a series of discrete movements.

16. The apparatus of claim 9, wherein the controller is physically mounted to the fuser assembly.

17. The apparatus of claim 9, wherein the controller rotates the backup roll at the beginning of the period of time in response to the actual temperature being at or below a first predetermined temperature.

18. The apparatus of claim 17, wherein during the period of time, the controller estimates whether a temperature of the backup roll is above a second predetermined temperature, and responsive to an affirmative estimation ceases rotating the backup roll.

19. The apparatus of claim 17, wherein during the period of time, the heater element remains activated and the backup roll continues to rotate for at least one of a predetermined period of time and a predetermined distance of the backup roll.

20. The apparatus of claim 9, wherein the ending of the period of time occurs responsive to the actual temperature of the backup roll reaching or surpassing a predetermined temperature.

21. The apparatus of claim 9, wherein the estimated temperature of the backup roll is based at least in part upon at least one of a last actual temperature measurement of the backup roll, thermal characteristics of the heater element and the backup roll, one or more environmental conditions of the apparatus, and a rotational speed of the backup roll during the period of time.

22. The apparatus of claim 21, further comprising at least one counter communicatively coupled to the controller for counting, wherein the at least one counter counts one of the period of time and a number of rotations of the backup roll during the period of time.

23. The apparatus of claim 9, wherein at the ending of the period of time, the controller causes the backup roll to cease rotating and a fusing nip of the fuser assembly to open, the fusing nip disposed between the heater element and the backup roll.

24. An apparatus, comprising:

a fuser assembly comprising a heat transfer member and a backup member positioned to engage the heat transfer member thereby defining a fusing nip therewith; and a controller coupled to the fuser assembly, wherein during a period of time when the fuser assembly is not performing a fusing operation, the controller causes the backup member to rotate at least one relatively slow speed relative to a fusing speed of the fuser assembly, at least one of a beginning and an ending of the period of the time being based upon an actual temperature of the backup member, wherein the controller causes the backup member to cease rotating and the fusing nip to open at the ending of the period of time, wherein the actual temperature of the backup member being at or below a first predetermined temperature causes the controller to begin rotating the backup member at the at least one relatively slow speed at the beginning of the period of time, and wherein during the period of time, the controller estimates whether a temperature of the backup member is at or above a second predetermined temperature, the controller ceasing rotation of the backup member at the ending of the period of time responsive to an affirmative estimation.

* * * * *